US011142814B2

(12) United States Patent
Mizutani et al.

(10) Patent No.: US 11,142,814 B2
(45) Date of Patent: Oct. 12, 2021

(54) FERRITIC-AUSTENITIC DUPLEX STAINLESS STEEL SHEET

(71) Applicant: JFE Steel Corporation, Tokyo (JP)

(72) Inventors: Akito Mizutani, Tokyo (JP); Mitsuyuki Fujisawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 209 days.

(21) Appl. No.: 16/479,120

(22) PCT Filed: Jan. 18, 2018

(86) PCT No.: PCT/JP2018/001293

§ 371 (c)(1),
(2) Date: Jul. 18, 2019

(87) PCT Pub. No.: WO2018/135554

PCT Pub. Date: Jul. 26, 2018

(65) Prior Publication Data

US 2019/0390310 A1 Dec. 26, 2019

(30) Foreign Application Priority Data

Jan. 23, 2017 (JP) ..... JP2017-009132
Dec. 25, 2017 (JP) ..... JP2017-247171

(51) Int. Cl.
*C22C 38/42* (2006.01)
*C22C 38/00* (2006.01)
(Continued)

(52) U.S. Cl.
CPC ..... *C22C 38/42* (2013.01); *C21C 5/005* (2013.01); *C21D 9/46* (2013.01); *C22C 38/001* (2013.01);
(Continued)

(58) Field of Classification Search
CPC ..... C22C 38/001; C22C 38/02; C22C 38/06; C22C 38/42; C22C 38/44; C22C 38/50;
(Continued)

(56) References Cited

U.S. PATENT DOCUMENTS 9,212,412 B2 12/2015 Oikawa et al.
2008/0089803 A1* 4/2008 Okada ..... F28F 21/083 420/38
2019/0226068 A1 7/2019 Bonnefois et al.

FOREIGN PATENT DOCUMENTS

EP 1867748 A1 12/2007
EP 2172574 A1 4/2010
(Continued)

OTHER PUBLICATIONS

Bonnefois et al., EP 1 867 748 A1 machine translation, Dec. 19, 2007, entire translation (Year: 2007).*
(Continued)

*Primary Examiner* — Humera N. Sheikh
*Assistant Examiner* — Katherine A Christy
(74) *Attorney, Agent, or Firm* — Ratnerprestia

(57) ABSTRACT

Provided is a ferritic-austenitic duplex stainless steel sheet in which no blowholes are formed during welding and which has excellent strength.

A chemical composition includes, in mass %, C: 0.10% or less, Si: 1.0% or less, Mn: 2.0 to 7.0%, P: 0.07% or less, S: 0.030% or less, Cr: 18.0 to 24.0%, Ni: 0.1 to 3.0%, Mo: 0.01 to 1.0%, Cu: 0.1 to 3.0%, Al: 0.003 to 0.10%, Zr: 0.01 to 0.50%, and N: 0.15 to 0.30%, with the balance being Fe and incidental impurities, the chemical composition satisfying formula (1) below and formula (2) below.

$$N-Zr/6.5 \geq 0.15\% \quad (1)$$

$$N-Zr/6.5 \leq 0.23\% \quad (2)$$

(Continued)

Here, in formula (1) and formula (2), N represents a content (mass %) of the corresponding chemical element N and Zr represents a content (mass %) of the corresponding chemical element Zr.

16 Claims, 1 Drawing Sheet

(51) Int. Cl.

| | |
|---|---|
| ***C22C 38/02*** | (2006.01) |
| ***C22C 38/06*** | (2006.01) |
| ***C22C 38/44*** | (2006.01) |
| ***C22C 38/50*** | (2006.01) |
| ***C22C 38/54*** | (2006.01) |
| ***C22C 38/58*** | (2006.01) |
| ***C21C 5/00*** | (2006.01) |
| ***C21D 9/46*** | (2006.01) |

(52) U.S. Cl.
CPC ..... *C22C 38/02* (2013.01); *C22C 38/06* (2013.01); *C22C 38/44* (2013.01); *C22C 38/50* (2013.01); *C22C 38/54* (2013.01); *C22C 38/58* (2013.01); *C21D 2211/001* (2013.01); *C21D 2211/005* (2013.01)

(58) Field of Classification Search
CPC ... C22C 38/54; C22C 38/58; C21D 2211/001; C21D 2211/005
USPC ..... 148/325
See application file for complete search history.

(56) References Cited

FOREIGN PATENT DOCUMENTS

| | | | |
|---|---|---|---|
| EP | 2258885 | A1 | 12/2010 |
| EP | 2662461 | A1 | 11/2013 |
| EP | 3276028 | A1 | 1/2018 |
| JP | 2009249658 | A | 10/2009 |
| JP | 4760031 | B2 | 8/2011 |
| JP | 4760032 | B2 | 8/2011 |
| JP | 5345070 | B2 | 11/2013 |
| JP | 2013234344 | A | 11/2013 |
| JP | 2016180172 | A | 10/2016 |
| JP | 2016191094 | A | 11/2016 |
| JP | 2017002352 | A | 1/2017 |
| WO | 0227056 | A1 | 4/2002 |
| WO | 2013133259 | A | 9/2013 |
| WO | 2016152622 | A1 | 9/2016 |

OTHER PUBLICATIONS

International Search Report and Written Opinion for International Application No. PCT/JP2018/001293, dated Mar. 9, 2018—5 pages.
Korean Office Action for Korean Application No. 10-2019-7021208, dated Nov. 23, 2020, with Concise Statement of Relevance of Office Action, 6 pages.
Extended European Search Report for European Application No. 18 741.199.6, dated Dec. 12, 2019, 9 pages.
Chinese Office Action for Chinese Application No. 201880907678.9, dated Sep. 3, 2020 with Concise Statement of Relevance of Office Action, 8 pages.
Chinese Office Action for Chinese Application No. 201880007678.9, dated May 10, 2021 with Concise Statement of Relevance of Office Action, 8 pages.

* cited by examiner

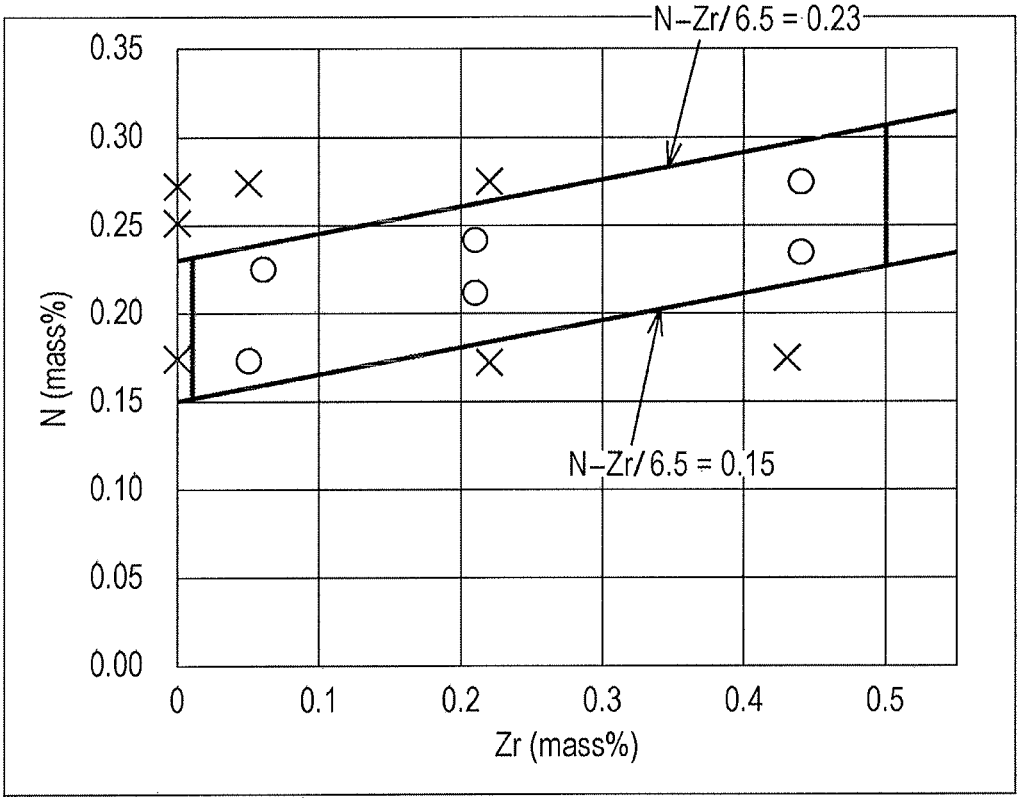
N−Zr/6.5 = 0.23
N−Zr/6.5 = 0.15
N (mass%)
0.35
0.30
0.25
0.20
0.15
0.10
0.05
0.00
0
0.1
0.2
0.3
0.4
0.5
Zr (mass%)

FERRITIC-AUSTENITIC DUPLEX STAINLESS STEEL SHEET

CROSS REFERENCE TO RELATED APPLICATIONS

This is the U.S. National Phase application of PCT/JP2018/001293, filed Jan. 18, 2018, which claims priority to Japanese Patent Application No. 2017-009132, filed Jan. 23, 2017 and Japanese Patent Application No. 2017-247171, filed Dec. 25, 2017, the disclosures of these applications being incorporated herein by reference in their entireties for all purposes.

FIELD OF THE INVENTION

The present invention relates to a ferritic-austenitic duplex stainless steel sheet having excellent weldability and strength.

BACKGROUND OF THE INVENTION

Ferritic-austenitic duplex stainless steels (hereinafter also referred to as duplex stainless steels) are steel grades having a duplex structure of ferrite (α) and austenite (γ) at room temperature and have characteristics such as high strength (high yield strength) and excellent stress corrosion cracking resistance. Duplex stainless steels are steel grades having a Ni content lower than that of γ-based stainless steels and which therefore have attracted attention in recent years from the standpoint of conserving rare elements. JIS G 4304 and JIS G 4305 specify three general-purpose duplex steel grades, one super duplex steel grade, and two lean (resource-saving, low Ni content) duplex steel grades.

In particular, SUS821L1 (representative components: 22 mass % Cr-2 mass % Ni-0.5 mass % Mo-1 mass % Cu-0.18 mass % N), which is a resource-saving duplex stainless steel, is a steel grade having a particularly low Ni content compared with conventional general-purpose duplex steels, which are typified by, for example, SUS329J3L (representative components: 22 mass % Cr-5 mass % Ni-3 mass % Mo-0.16 mass % N). Because of the low Ni content and low Mo content, the corrosion resistance of SUS821L1 is lower than those of other duplex stainless steels and is comparable to that of SUS304 (representative components: 18 mass % Cr-8 mass % Ni), which is a general-purpose γ-based stainless steel. On the other hand, in SUS821L1, relatively inexpensive elements, such as N, Mn, and Cu, are utilized as γ-phase-forming elements in place of Ni, which is expensive, and therefore price stability thereof is excellent. Furthermore, SUS821L1 has a higher yield strength than SUS304 and therefore can be used for structural members for which SUS304 has not been able to be used because of its low yield strength.

From such circumstances, resource-saving duplex stainless steels, such as SUS821L1, are being increasingly used for structural members, such as a sluice gate, that need to have corrosion resistance. Duplex stainless steels having compositions similar to those of SUS821L1 are described in Patent Literature 1 to 3, for example. Features of each of the steels described in the above-mentioned documents include a reduced amount of Ni and increased amounts of N, Mn, and Cu.

PATENT LITERATURE

PTL 1: Japanese Patent No. 4760031
PTL 2: Japanese Patent No. 4760032
PTL 3: Japanese Patent No. 5345070

SUMMARY OF THE INVENTION

As the application range of duplex stainless steels, which are described above, has been expanding in recent years, duplex stainless steels having higher strengths have been desired. In particular, in a case where the purpose of use is to reduce the thickness and weight of a member for which SUS304 has been-used to date, increasing strength is an important challenge because the higher the strength (yield strength, in particular), the higher the degree of thickness reduction that can be achieved, as compared with the related art. It is well known that increasing the amount of N is effective for increasing the strength of duplex stainless steels. The reason is that increasing N results in an increase in the amount of dissolved N in the γ phase and therefore an increase in strength. In addition, N contributes to improving corrosion resistance and increasing the γ-phase fraction and is therefore actively contained in duplex stainless steels.

Increasing the amount of N in duplex stainless steels is beneficial from the standpoint of improving strength and corrosion resistance as described above but poses problems such as a tendency to be a factor that causes welding defects. In the process of welding duplex stainless steel, the solidified structure of the weld metal zone has an α-single-phase, and in the process of cooling, the γ phase forms, so that the structure returns to the α-γ duplex structure. Furthermore, in the cooling process, the heat affected zone (HAZ) near the weld metal zone returns to the α-γ duplex structure after once heated to an α-single-phase temperature region. Both of the sites undergo the process of change from an α-single-phase structure to an α-γ duplex structure in the process of cooling after welding, but in some cases, the formation of the γ phase during cooling is insufficient because of a high cooling rate, which results in a reduction in the γ-phase fraction compared with that prior to welding. In a case where the γ-phase fraction is reduced and the concentration of N in the α phase increases, since the amount of dissolved N in the α phase is smaller than that in the γ phase, corrosion resistance at the grain boundaries may decrease as a result of precipitation of $Cr_2N$, and bubbles may be formed when N above the solubility limit vaporizes and may be entrapped in the weld bead during solidification, which is a defect (hereinafter referred to as blowholes) that may occur. In particular, if blowholes are formed, the strength of the weld joint decreases, and as a result, the use for a structural member is difficult. As described above, increasing N to increase strength results in a decrease in weldability, and therefore achieving both high strength and weldability is a significant challenge for duplex stainless steels.

The stainless steels described in Patent Literature 1 and Patent Literature 2, listed above, have a N content increased to approximately 0.6% at a maximum and therefore can have high strength; however, in steels having an amount of N greater than 0.2%, there have been cases in which blowholes have been formed during welding. The stainless steel described in Patent Literature 3 has increased corrosion resistance and toughness of the weld heat affected zone; however, there have been cases in which the strength of the base metal has been insufficient for use for a structural member. With SUS821L1, described in JIS G 4304 and JIS G 4305, almost no blowholes have been formed because the amount of N is as low as 0.15 to 0.20%, but there have also been cases in which the strength thereof has been insufficient.

Accordingly, an object according to aspects of the present invention is to provide a ferritic-austenitic duplex stainless steel sheet in which no blowholes are formed during welding and which has excellent strength.

Here, in accordance with aspects of the present invention, the phrase "in which no blowholes are formed during welding" means that, when machined edge face of two steel sheets having a thickness of 4.0 mm are butt-welded together by TIG welding, and then entire cross sections of the weld metal zone and the HAZ are examined, no blowholes 3 μm or greater in diameter are present. The groove is an I-type groove. The welding conditions are as follows: current, 220 A; voltage, 15 V; welding speed, 200 mm/min; welding wire, none; shielding gas, Ar; gas flow rate, 15 l/min for both front and back sides.

Furthermore, in accordance with aspects of the present invention, the phrase "excellent strength" refers to 0.2% yield strengths of 480 MPa or greater, as measured in accordance with JIS Z 2241.

The present inventors diligently performed studies to achieve the object described above and found that appropriately controlling the balance between Zr and N makes it possible to increase the strength of the structure without excessively increasing the amount of N in the α phase. Hence, strength can be increased while suppressing the formation of blowholes during welding.

Aspects of the present invention were made based on such findings, and a summary of aspects of the present invention is as follows.

[1] A ferritic-austenitic duplex stainless steel sheet having a chemical composition containing, in mass %, C: 0.10% or less, Si: 1.0% or less, Mn: 2.0 to 7.0%, P: 0.07% or less, S: 0.030% or less, Cr: 18.0 to 24.0%, Ni: 0.1 to 3.0%, Mo: 0.01 to 1.0%, Cu: 0.1 to 3.0%, Al: 0.003 to 0.10%, Zr: 0.01 to 0.50%, and N: 0.15 to 0.30%, with the balance being Fe and incidental impurities, the chemical composition satisfying formula (1) below and formula (2) below, $$N—Zr/6.5 \geq 0.15\% \quad (1)$$

$$N—Zr/6.5 \leq 0.23\% \quad (2)$$

where, in formula (1) and formula (2), N represents a content (mass %) of the corresponding chemical element N and Zr represents a content (mass %) of the corresponding chemical element Zr.

[2] A ferritic-austenitic duplex stainless steel sheet having a chemical composition containing, in mass %, C: 0.10% or less, Si: 1.0% or less, Mn: 2.0 to 7.0%, P: 0.07% or less, S: 0.030% or less, Cr: 18.0 to 24.0%, Ni: 0.1 to 3.0%, Mo: 0.1 to 1.0%, Cu: 0.1 to 3.0%, Al: 0.003 to 0.10%, Zr: 0.01 to 0.50%, and N: 0.15 to 0.30%, with the balance being Fe and incidental impurities, the chemical composition satisfying formula (1) below and formula (2) below, $$N—Zr/6.5 \geq 0.15\% \quad (1)$$

$$N—Zr/6.5 \leq 0.23\% \quad (2)$$

where, in formula (1) and formula (2), N represents a content (mass %) of the corresponding chemical element N and Zr represents a content (mass %) of the corresponding chemical element Zr.

[3] The ferritic-austenitic duplex stainless steel sheet according to [1] or [2], wherein the chemical composition further contains, in mass %, one or more of B: 0.01% or less, Ca: 0.01% or less, Mg: 0.01% or less, and one or more REMs (rare earth metals): 0.1% or less.

Aspects of the present invention make it possible to obtain a ferritic-austenitic duplex stainless steel sheet in which no blowholes are formed during welding and which has excellent strength.

BRIEF DESCRIPTION OF DRAWINGS

The FIGURE is a graph demonstrating that Zr and N contents have influence on the properties of steel.

DETAILED DESCRIPTION OF EMBODIMENTS OF THE INVENTION

An embodiment of the present invention will now be described. Note that the present invention is not limited to the following embodiment.

First, control of a balance between the Zr content and the N content, which is a point according to aspects of the present invention, will be described. When the N content is increased for the purpose of increasing the strength of duplex stainless steel, a problem arises in that blowhole defects tend to occur during welding. In view of this, the present inventors diligently searched for a new strengthening technique that does not depend on excessively increasing the amount of dissolved N. As a result, it was found that, when Zr is included in an appropriate amount, yield strength increases. It is presumed that precipitation of ZrN in the steel resulted in grain refinement and therefore increased yield strength. On the other hand, since Zr combines with N in the steel and precipitates, including an excessive amount of Zr decreases the amount of dissolved N in the steel, which causes to decrease strength and the γ-phase fraction. Achieving even higher strength by increasing the amount of precipitation of ZrN requires that the N content also be increased in accordance with the Zr content.

To identify an optimal balance between the contents of Zr and N, the present inventors prepared a variety of steels with various Zr and N contents and investigated their strengths and formation of blowhole during welding. First, steels containing the components of Steels Nos. 1 to 6 and Steels Nos. 16 to 22, shown in Table 1, which will be described later in the "Examples" section, were produced by melting, and hot-rolled and annealed sheets having a thickness of 4.0 mm were prepared in a manner that will also be described later in the "Examples" section. The hot-rolled and annealed sheets were subjected to a tensile test and a welding test in manners that will also be described later in the "Examples" section, and the strength and the formation of blowhole were investigated.

The results are shown in the FIGURE. The FIGURE is a graph demonstrating that Zr and N contents have influence on the properties of steel.

The FIGURE shows the results of evaluation of properties of the steels on the following two items.

(1) Strength ["Pass" if 480 MPa≤yield strength (0.2% yield strength)]

(2) Presence or absence of blowholes during welding ["Pass" if no blowholes 3 μm or greater in diameter are formed]

In the FIGURE, steels rated as "pass" for both of the two items are indicated by "○", and steels which failed in even one of these two items are indicated by "x". These results indicate that, when a steel sheet contains Zr: 0.01 to 0.50% and N: 0.15 to 0.30% and satisfies the relationships N—Zr/6.5≥0.15% . . . (1) and N—Zr/6.5≥0.23% . . . (2), the ratings are "pass" for both of the items. In formula (1) and formula (2), N represents the content (mass %) of the corresponding chemical element N and Zr represents the content (mass %) of the corresponding chemical element Zr.

Here, "N—Zr/6.5" on the left side of formula (1) and formula (2) represents the amount of dissolved N in the steel on the assumption that the whole of included Zr precipitates as ZrN and N that is not involved in the precipitation of ZrN is wholly dissolved in the steel. That is, the formulas indicate that controlling the amount of dissolved N to be within the range of 0.15 to 0.23% is necessary to pass all the evaluations. If the Zr content is excessive relative to the amount of N in the steel and consequently the amount of dissolved N is less than 0.15%, the reduction in the amount of dissolved N in the γ phase significantly reduces strength, and therefore the target strength cannot be achieved in spite of the presence of Zr. Furthermore, since N is also a γ-phase-forming element, a reduction in dissolved N may result in an insufficient γ-phase fraction. On the other hand, if the Zr content is insufficient relative to the amount of N in the steel and consequently the amount of dissolved N exceeds 0.23%, blowholes may be formed during welding because of the excessive amount of dissolved N. In addition, in the case that Zr is not included, the target strength cannot be attained if the N content is within the range in which blowholes are not formed.

The present inventors performed studies on an optimal balance between the contents of Zr and N on the basis of the above findings and determined that the lower limit of the amount of dissolved N is to be 0.15% and the upper limit thereof is to be 0.23% and thus made aspects of the present invention. By ensuring that the Zr content and the N content are within the range of the present invention, a further increase in strength due to precipitation of ZrN can be achieved while an appropriate amount of dissolved N is maintained, and therefore the target properties can be attained.

As described above, aspects of the present invention are realized by controlling the balance between the amount of Zr and the amount of N in a manner such that the target strength and γ-phase fraction are ensured while utilizing strength increase due to the presence of Zr and that the amount of N at which no blowholes are formed is ensured.

A ferritic-austenitic duplex stainless steel sheet according to aspects of the present invention, based on the technical ideas described above, has a chemical composition containing, in mass %, C: 0.10% or less, Si: 1.0% or less, Mn: 2.0 to 7.0%, P: 0.07% or less, S: 0.030% or less, Cr: 18.0 to 24.0%, Ni: 0.1 to 3.0%, Mo: 0.01 to 1.0%, Cu: 0.1 to 3.0%, Al: 0.003 to 0.10%, Zr: 0.01 to 0.50%, and N: 0.15 to 0.30%, with the balance being Fe and incidental impurities, the chemical composition satisfying formula (1) below and formula (2) below.

The ferritic-austenitic duplex stainless steel sheet is a steel sheet in which no blowholes are formed during welding and having excellent strength.

$$N—Zr/6.5 \geq 0.15\% \quad (1)$$

$$N—Zr/6.5 \leq 0.23\% \quad (2)$$

In formula (1) and formula (2), N represents a content (mass %) of the corresponding chemical element N and Zr represents a content (mass %) of the corresponding chemical element Zr.

In a more preferable-embodiment, the chemical composition contains, in mass %, C: 0.10% or less, Si: 1.0% or less, Mn: 2.0 to 7.0%, P: 0.07% or less, S: 0.030% or less, Cr: 18.0 to 24.0%, Ni: 0.1 to 3.0%, Mo: 0.1 to 1.0%, Cu: 0.1 to 3.0%, Al: 0.003 to 0.10%, Zr: 0.01 to 0.50%, and N: 0.15 to 0.30%, with the balance being Fe and incidental impurities, the chemical composition satisfying formula (1) below and formula (2) below.

$$N—Zr/6.5 \geq 0.15\% \quad (1)$$

$$N—Zr/6.5 \leq 0.23\% \quad (2)$$

In formula (1) and formula (2), N represents a content (mass %) of the corresponding chemical element N and Zr represents a content (mass %) of the corresponding chemical element Zr.

The following description describes in detail reasons for the limitation on the chemical composition of the stainless steel sheet according to aspects of the present invention. The unit "%" for the content of each of the component elements described below means "mass %". Furthermore, in the following description, the ferritic phase is also referred to as the a phase, and the austenitic phase is also referred to as the y phase.

C: 0.10% or less

C is an element that increases the γ-phase fraction. A preferable C content to obtain the above-described effect is 0.003% or greater. On the other hand, if the C content is greater than 0.10%, the temperature for heat treatment for dissolving C is to be significantly high, which reduces productivity. Accordingly, the C content is not greater than 0.10%. The C content is preferably less than 0.050%, more preferably less than 0.030%, and even more preferably less than 0.020%.

Si: 1.0% or less

Si is an element that is contained as a deoxidizer, and it is preferable that Si be present in an amount not less than 0.01%. On the other hand, if the Si content is greater than 1.0%, the strength of the steel material increases, which reduces cold workability. Furthermore, since Si is an a-phase-forming element, a Si content of greater than 1.0% may make it difficult to obtain the desired γ-phase fraction. Accordingly, the Si content is not greater than 1.0%. The Si content is preferably not greater than 0.70%, more preferably not greater than 0.50%, and even more preferably not greater than 0.35%.

Mn: 2.0 to 7.0%

Mn has effects of, by increasing the amount of dissolved N in the α phase, preventing sensitization at α-phase grain boundaries and suppressing the formation of blowholes during welding. To obtain the above effects, Mn needs to be contained in an amount of 2.0% or greater. On the other hand, if the Mn content is greater than 7.0%, hot workability and corrosion resistance decrease. Accordingly, the Mn content is 2.0 to 7.0%. The Mn content is preferably not greater than 5.00%, more preferably not greater than 4.00%, and even more preferably not greater than 3.50%.

P: 0.07% or less

P is an element that reduces corrosion resistance and hot workability. If the P content is greater than 0.07%, the harmful effects are noticeable, and therefore the P content is not greater than 0.07%. The P content is preferably not greater than 0.05% and more preferably not greater than 0.040%.

S: 0.030% or less

S is an element that reduces corrosion resistance and hot workability. If the S content is greater than 0.030%, the harmful effects are noticeable, and therefore the S content is not greater than 0.030%. The S content is preferably not greater than 0.010% and more preferably not greater than 0.005%.

Cr: 18.0 to 24.0%

Cr is the most important component for imparting corrosion resistance to a stainless steel. If the Cr content is less than 18.0%, sufficient corrosion resistance is not achieved. On the other hand, Cr is an α-phase-forming element, and, if the Cr content is greater than 24.0%, obtaining a sufficient amount of γ-phase fraction is difficult. Accordingly, the Cr content is 18.0 to 24.0%. The Cr content is preferably not less than 19.0% and more preferably not less than 20.5%. Furthermore, the Cr content is preferably not greater than 23.0% and more preferably not greater than 22.0%.

Ni: 0.1 to 3.0%

Ni is a γ-phase-forming element and has an effect of improving crevice corrosion resistance. Furthermore, addition of Ni to a duplex stainless steel improves the corrosion resistance of the ferrite phase and increases pitting potential. To obtain these effects, Ni needs to be contained in an amount of 0.1% or greater. On the other hand, if the Ni content is greater than 3.0%, the amount of Ni in the α phase increases and the ductility of the α phase decreases, which results in a decrease in formability. Furthermore, Ni is an element that is expensive and very susceptible to price fluctuations, and therefore, an increase in the Ni content compromises price stability, which is inconsistent with a purpose of the present invention. Accordingly, the Ni content is 0.1 to 3.0%. The Ni content is preferably not less than 0.50% and more preferably not less than 1.50%. Furthermore, it is preferable that the Ni content not be greater than 2.50%.

Mo: 0.01 to 1.0%

Mo has an effect of improving corrosion resistance. To obtain this effect, Mo needs to be contained in an amount of 0.01% or greater. On the other hand, if the Mo content is greater than 1.0%, high-temperature strength increases, which results in a decrease in hot workability. Furthermore, Mo is an element that is expensive and very susceptible to price fluctuations, and therefore, an increase in the Mo content compromises price stability, which is inconsistent with a purpose of the present invention. Accordingly, the Mo content is 0.01 to 1.0%. The Mo content is preferably not less than 0.1% and more preferably not less than 0.20%. Furthermore, the Mo content is preferably not greater than 0.60% and more preferably not greater than 0.40%.

Cu: 0.1 to 3.0%

Cu is a γ-phase-forming element and has an effect of increasing the γ-phase fraction. To obtain this effect, Cu needs to be contained in an amount of 0.1% or greater. On the other hand, if the Cu content is greater than 3.0%, high-temperature strength increases, which results in a decrease in hot workability. Accordingly, the Cu content is 0.1 to 3.0%. The Cu content is preferably not less than 0.20%, more preferably not less than 0.30%, and even more preferably not less than 0.50%. Furthermore, the Cu content is preferably not greater than 1.50% and more preferably not greater than 1.20%.

Al: 0.003 to 0.10%

Al is a deoxidizer, and the effect is obtained when Al is contained in an amount of 0.003% or greater. If the Al content is greater than 0.10%, however, nitrides are formed, which can cause surface defects. Accordingly, the Al content is 0.003 to 0.10%. The Al content is preferably not less than 0.005% and more preferably not less than 0.010%. Furthermore, the Al content is preferably not greater than 0.050% and more preferably not greater than 0.030%.

Zr: 0.01 to 0.50%

Zr is an important element for increasing the strength of steel. The effect is obtained when Zr is contained in an amount of 0.01% or greater. On the other hand, if Zr is contained in an amount greater than 0.50%, the effect reaches saturation, and moreover, Zr inclusions may cause surface defects. Furthermore, the alloying cost increases, which is not preferable. Accordingly, the Zr content is 0.01 to 0.50%. The Zr content is preferably not less than 0.03% and more preferably not less than 0.05%. Furthermore, the Zr content is preferably not greater than 0.20% and more preferably not greater than 0.10%.

N: 0.15 to 0.30%

N is a γ-phase-forming element and increases corrosion resistance and strength and is therefore an important element. This effect is obtained when N is contained in an amount of 0.15% or greater. On the other hand, if the N content is greater than 0.30%, N becomes a factor that causes the formation of blowholes during casting and during welding. Accordingly, the N content is 0.15 to 0.30%. It is preferable that the N content not be less than 0.170%. Furthermore, the N content is preferably not greater than 0.250% and more preferably not greater than 0.200%.

N—Zr/6.5≥0.15%

If N—Zr/6.5 is less than 0.15%, the reduction in the amount of dissolved N in the γ phase occurs, which significantly cause to reduce strength. As a result, even with the effect of strength increase due to the presence of Zr, the target strength cannot be achieved. Furthermore, since N is also a γ-phase-forming element, a reduction in dissolved N may result in an insufficient γ-phase fraction. Accordingly, N-Zr/6.5 is not less than 0.15%. N—Zr/6.5 is preferably not less than 0.16% and more preferably not less than 0.17%.

N—Zr/6.5≤0.23%

If N—Zr/6.5 is greater than 0.23%, the amount of dissolved N is excessive, and therefore blowholes may be formed during welding. Accordingly, N—Zr/6.5 is not greater than 0.23%. N-Zr/6.5 is preferably not greater than 0.21% and more preferably not greater than 0.20%.

In the stainless steel according to aspects of the present invention, the balance, other than the components described above, is Fe and incidental impurities. Note that, from the standpoint of preventing surface defects due to inclusions, it is preferable that O (oxygen) be controlled to be in an amount not greater than 0.05%.

The stainless steel according to aspects of the present invention may include the following components as necessary, in addition to the essential components described above.

One or more of B: 0.01% or less, Ca: 0.01% or less, Mg: 0.01% or less, and REMs: 0.1% or less B, Ca, and Mg are components that improve hot workability and may be included as appropriate. A preferable B content, a preferable Ca content, and a preferable Mg content, to obtain the effect, are each not less than 0.0003%. On the other hand, if the B content, the Ca content, or the Mg content is greater than 0.01%, corrosion resistance decreases. Accordingly, when one or more of Ba, Ca, and Mg are to be included, it is preferable that the content of each of Ba, Ca, and Mg be limited to not greater than 0.01%. It is more preferable that the B content, the Ca content, and the Mg content each not be greater than 0.005%. Similarly, one or more REMs may be included as appropriate, as a component that improves hot workability. When one or more REMs are to be contained, it is preferable that the REMs content not be less than 0.002%. On the other hand, if the REMs content is greater than 0.1%, corrosion resistance decreases. Accordingly, it is preferable that the REMs content be limited to not greater than 0.1%. It is more preferable that the REMs content not be greater than 0.05%. Note that REMs are Sc, Y, and lanthanide series elements (elements having-atomic numbers 57 to 71, such as La, Ce, Pr, Nd, and Sm).

It is preferable that the γ-phase fraction in the structure of the ferritic-austenitic duplex stainless steel sheet according to aspects of the present invention not be less than 30% so that good strength can be achieved. Furthermore, it is preferable that the γ-phase fraction not be greater than 70% so that good corrosion resistance can be achieved.

Now, preferable methods for manufacturing the stainless steel sheet according to aspects of the present invention will be described. The manufacturing method is not particularly limited, and the following method may be used, for example. A steel having a chemical composition as described above is produced by steelmaking in a converter or an electric furnace and subsequent refining by VOD (vacuum oxygen decarburization), AOD (argon oxygen decarburization), or the like. Then the steel is subjected to ingot-slabbing or continuous casting to form a slab. The slab is heated to a temperature of 1200 to 1300° C. and hot-rolled into a hot-rolled steel sheet or plate. It is preferable that the hot-rolled steel sheet obtained using such a method be subsequently subjected, as necessary, to continuous annealing at a temperature between 900 and 1200° C. and thereafter to descaling by pickling, grinding, or the like. In pickling, sulfuric acid, a mixture of nitric acid and hydrofluoric acid, or the like may be used, for example. Note that, as necessary, shot blasting may be performed prior to pickling to remove scale. The hot-rolled steel sheet may be subjected to annealing and cold rolling to manufacture a cold-rolled steel sheet. It is preferable that the cold-rolled steel sheet obtained using such a method be subsequently subjected, as necessary, to continuous annealing at a temperature between 900 and 1200° C. and thereafter to descaling by pickling, grinding, or the like. As necessary, bright annealing may be performed at a temperature between 900 and 1200° C.

EXAMPLE

The present invention will now be described in more detail with reference to examples. Note that the present invention is not limited to the examples below.

Steels having a chemical composition as shown in Table 1, which were produced by melting using a 50-kg small vacuum melting furnace, were heated to 1250° C. and thereafter hot-rolled to form a hot-rolled steel sheet having a sheet thickness of 4.0 mm. Subsequently, annealing was performed under conditions: in air atmosphere, at 1100° C., and for 1 minute. Thereafter, shot blasting and grinding with a grinder were performed to remove surface scale, and thus a hot-rolled and annealed sheet was obtained. Each of the hot-rolled and annealed sheets obtained as described above was evaluated on the following items.

(1) γ-Phase Fraction

A test piece of 15 mm length and 10 mm width was cut from the hot-rolled and annealed sheet and was embedded in a resin in such a manner that a cross section parallel to the rolling direction served as the surface to be examined, and the cross section was mirror-polished. Subsequently, a coloring treatment was performed using Murakami's reagent (an aqueous solution in which 100 g of potassium ferricyanide, 100 g of an aqueous solution of potassium hydroxide, and 100 $cm^3$ of pure water were mixed together), and thereafter an examination was performed with an optical microscope. In coloring using Murakami's reagent, only the α phase is colored gray (after being etched, the surface diffuses light. Thus, the α phase is darker than the γ-phase portions and appears to have been colored gray), and the γ phase remains white without being colored (the surface remains to be the mirror-polished surface without being etched and is bright). Utilizing this reaction, the γ phase and the α phase were distinguished from each other, and thereafter the γ-phase fraction was calculated by image analysis. The examination was carried out for five fields of view at a magnification of 200 times, and the γ-phase fraction was determined as the average of the area fractions thereof in the five fields.

(2) Yield Strength by Tensile Test

A JIS No. 13B tensile test piece was cut from the hot-rolled and annealed sheet in a manner such that a direction parallel to the rolling direction corresponds to the long dimension of the test piece, and a tensile test was conducted in accordance with JIS Z 2241 to measure a 0.2% yield strength. 0.2% yield strengths greater than or equal to 480 MPa were rated as "pass" (○), and 0.2% yield strengths less than 480 MPa were rated as "fail" (x). Note that, in this instance, the target strength was set on the assumption that the duplex stainless steel is to be used for the purpose of reducing thicknesses and weights in applications in which SUS304 is currently used. A measurement performed by the present inventors indicated that the yield strength of a SUS304 hot-rolled and annealed sheet having a thickness of 4.0 mm was approximately 240 MPa. Here, consider a case in which an existing member made of SUS304 is replaced by a replacement member made of a duplex stainless steel having a reduced thickness, the reduced thickness being the only change from the existing member. For example, it is presumed that, when tensile loads applied to these members are equal, to prevent yielding under the equal load condition, the yield strength of the duplex stainless steel needs to be increased by at least an amount corresponding to the ratio at which the sheet thickness is reduced. In this instance, the target was to reduce the sheet thickness to 50% of that of SUS304, which is a steel of the related art, and the target yield strength of the duplex stainless steel was specified to be a yield strength increased from that of SUS304 by 100%. Specifically, the target yield strength of the duplex stainless steel was set to 480 MPa or greater, with respect to the yield strength of 240 MPa of SUS304.

(3) Presence or Absence of Blowholes Formed During Welding

A test piece of 35 mm×150 mm (width×length) was cut from the hot-rolled and annealed sheet, and one of the longitudinal edge surfaces was machined to reduce the width by 5 mm to obtain a size of 30 mm×150 mm (width×length). Two such test pieces were prepared, and the machined surfaces were butt-welded together by TIG welding. The groove was an I-type groove. The welding conditions were as follows: current, 220 A; voltage, 15 V; welding speed, 200 mm/min; welding wire, none; shielding gas, Ar; gas flow rate, 15 l/min for both front and back sides. Ten test pieces for cross-sectional examination were cut from positions of the weld obtained in the above-described manner at intervals of 15 mm along the length of the weld, and the presence or absence of blowholes was determined with an optical microscope (at a magnification of 200 times). The entire cross sections of the weld metal zone and the HAZ were examined, and the rating of "pass" (○) was given if no blowholes 3 μm or greater in diameter were present, and the rating of "fail" (x) was given if a blowhole 3 μm or greater in diameter was present.

(4) Corrosion Resistance

Corrosion resistance was evaluated based on pitting potentials. First, a test piece of 20×20 mm was cut from the hot-rolled and annealed sheet, and the test piece was sealed with a resin except for a portion of 11×11 mm of the surface and thereafter subjected to a passivation treatment by being immersed in nitric acid at a concentration of 10 mass %, and then a portion of 10×10 mm of the surface was polished. Next, in accordance with JIS G 0577, the test piece was immersed in a 3.5 mass % NaCl aqueous solution at 30° C. and thereafter left standing for 10 minutes, and then potential scanning was started to measure the pitting potential. In the pitting potential measurement results, pitting potentials less than 270 (mV vs. SCE) were rated as "x", pitting potentials 270 or greater (mV vs. SCE) and less than 320 (mV vs. SCE) were rated as "○" (pass), and pitting potentials greater than or equal to 320 (mV vs. SCE) were rated as "⊙" (pass: excellent). It was determined that, if a rating of ○ or ⊙ was given, corrosion resistance was excellent and therefore the use for structural members, such as a sluice gate, that particularly need to have corrosion resistance would be possible.

Results of the various evaluations are shown in Table 1 and Table 2.

TABLE 1

| Steel | Chemical composition (mass %) | | | | | | | | | | | |
|---|---|---|---|---|---|---|---|---|---|---|---|---|
| No. | C | Si | Mn | P | S | Cr | Ni | Mo | Cu | Al | Zr | N |
| 1 | 0.014 | 0.31 | 2.95 | 0.031 | 0.001 | 21.1 | 1.98 | 0.31 | 1.02 | 0.013 | 0.05 | 0.173 |
| 2 | 0.015 | 0.30 | 2.99 | 0.031 | 0.002 | 21.0 | 1.97 | 0.30 | 1.02 | 0.017 | 0.21 | 0.212 |
| 3 | 0.015 | 0.31 | 3.01 | 0.030 | 0.001 | 20.9 | 1.95 | 0.33 | 1.03 | 0.020 | 0.44 | 0.235 |
| 4 | 0.015 | 0.32 | 2.98 | 0.033 | 0.001 | 20.9 | 1.97 | 0.29 | 1.03 | 0.016 | 0.44 | 0.275 |
| 5 | 0.013 | 0.33 | 3.00 | 0.031 | 0.001 | 21.2 | 1.97 | 0.29 | 1.04 | 0.016 | 0.06 | 0.225 |
| 6 | 0.015 | 0.32 | 3.02 | 0.032 | 0.002 | 21.0 | 2.00 | 0.29 | 0.99 | 0.020 | 0.21 | 0.242 |
| 7 | 0.014 | 0.32 | 2.95 | 0.031 | 0.001 | 21.1 | 1.98 | 0.32 | 0.51 | 0.013 | 0.05 | 0.171 |
| 8 | 0.016 | 0.29 | 3.01 | 0.033 | 0.001 | 21.0 | 1.97 | 0.33 | 0.12 | 0.013 | 0.15 | 0.245 |
| 9 | 0.015 | 0.32 | 2.97 | 0.030 | 0.001 | 21.0 | 0.46 | 0.28 | 1.02 | 0.020 | 0.06 | 0:226 |
| 10 | 0.015 | 0.32 | 6.12 | 0.031 | 0.002 | 20.9 | 0.48 | 0.31 | 1.02 | 0.013 | 0.08 | 0.171 |
| 11 | 0.016 | 0.31 | 2.11 | 0.033 | 0.001 | 21.2 | 1.97 | 0.29 | 0.99 | 0.016 | 0.09 | 0.238 |
| 12 | 0.021 | 0.31 | 3.00 | 0.031 | 0.001 | 20.9 | 1.97 | 0.82 | 1.03 | 0.015 | 0.05 | 0.211 |
| 13 | 0.025 | 0.31 | 2.08 | 0.033 | 0.001 | 18.6 | 2.00 | 0.56 | 1.04 | 0.016 | 0.40 | 0.224 |
| 14 | 0.018 | 0.29 | 2.98 | 0.029 | 0.001 | 23.2 | 2.09 | 0.33 | 2.87 | 0.021 | 0.06 | 0.175 |
| 15 | 0.017 | 0.11 | 3.01 | 0.028 | 0.001 | 21.9 | 2.91 | 0.93 | 0.21 | 0.082 | 0.08 | 0.184 |
| 16 | 0.015 | 0.32 | 2.97 | 0.031 | 0.001 | 21.0 | 1.97 | 0.31 | 1.01 | 0.015 | — | 0.174 |
| 17 | 0.015 | 0.32 | 3.01 | 0.032 | 0.002 | 21.1 | 1.93 | 0.32 | 0.98 | 0.015 | 0.22 | 0.172 |
| 18 | 0.013 | 0.32 | 3.03 | 0.033 | 0.001 | 20.9 | 1.99 | 0.31 | 1.10 | 0.013 | 0.43 | 0.175 |
| 19 | 0.013 | 0.32 | 3.02 | 0.033 | 0.001 | 21.2 | 2.01 | 0.29 | 1.02 | 0.013 | — | 0.272 |
| 20 | 0.014 | 0.31 | 2.97 | 0.034 | 0.002 | 21.0 | 1.98 | 0.28 | 1.10 | 0.017 | 0.05 | 0.274 |
| 21 | 0.015 | 0.31 | 3.01 | 0.030 | 0.001 | 21.0 | 1.98 | 0.31 | 1.04 | 0.015 | — | 0.251 |
| 22 | 0.015 | 0.32 | 2.99 | 0.031 | 0.001 | 21.0 | 1.98 | 0.31 | 1.08 | 0.014 | 0.22 | 0.275 |
| 23 | 0.015 | 0.32 | 3.01 | 0.030 | 0.001 | 26.2 | 1.95 | 0.33 | 1.12 | 0.020 | 0.05 | 0.225 |
| 24 | 0.014 | 0.30 | 3.00 | 0.033 | 0.001 | 21.2 | 1.98 | 0.29 | 1.03 | 0.016 | 0.06 | 0.121 |
| 25 | 0.015 | 0.32 | 2.95 | 0.032 | 0.001 | 21.0 | 2.08 | 0.29 | 0.51 | 0.020 | 0.05 | 0.312 |
| 26 | 0.025 | 0.35 | 8.16 | 0.023 | 0.002 | 23.5 | 0.23 | 0.91 | 2.13 | 0.057 | 0.21 | 0.232 |
| 27 | 0.022 | 0.36 | 1.31 | 0.035 | 0.002 | 22.6 | 2.06 | 0.33 | 1.53 | 0.064 | 0.16 | 0.179 |
| 28 | 0.015 | 0.32 | 3.05 | 0.028 | 0.001 | 21.4 | 2.03 | 0.02 | 1.10 | 0.021 | 0.05 | 0.174 |
| 29 | 0.016 | 0.30 | 3.10 | 0.031 | 0.001 | 21.4 | 2.04 | 0.05 | 0.95 | 0.016 | 0.04 | 0.176 |
| 30 | 0.020 | 0.29 | 3.02 | 0.030 | 0.001 | 21.4 | 2.05 | 0.08 | 0.98 | 0.020 | 0.04 | 0.162 |
| 31 | 0.022 | 0.31 | 3.05 | 0.030 | 0.001 | 21.3 | 2.05 | 0.05 | 1.04 | 0.018 | 0.05 | 0.160 |
| 32 | 0.019 | 0.27 | 3.14 | 0.033 | 0.001 | 21.5 | 2.07 | 0.03 | 0.92 | 0.018 | 0.08 | 0.201 |
| 33 | 0.016 | 0.24 | 3.08 | 0.029 | 0.001 | 21.2 | 2.07 | 0.06 | 0.97 | 0.018 | 0.17 | 0.203 |
| 34 | 0.018 | 0.25 | 3.11 | 0.025 | 0.002 | 21.3 | 209 | 0.05 | 0.91 | 0.018 | 0.41 | 0.243 |
| 35 | 0.019 | 0.26 | 5.23 | 0.029 | 0.001 | 21.3 | 1.98 | 0.28 | 1.03 | 0.019 | 0.05 | 0.168 |

| Steel No. | Chemical composition (mass %) Other components | N—Zr/6.5 | γ-phase fraction (%) | Notes |
|---|---|---|---|---|
| 1 | — | 0.165 | 45 | Invention example |
| 2 | — | 0.180 | 54 | Invention example |
| 3 | — | 0.167 | 59 | Invention example |
| 4 | — | 0.207 | 65 | Invention example |
| 5 | — | 0.216 | 55 | Invention example |
| 6 | — | 0.210 | 60 | Invention example |
| 7 | Ca: 0.0045 | 0.163 | 45 | Invention example |
| 8 | La: 0.011 Ce: 0.015 | 0.222 | 58 | Invention example |
| 9 | B: 0.0039, Ca: 0.0021, Mg: 0.0018 | 0.217 | 45 | Invention example |
| 10 | B: 0.0029 | 0.159 | 40 | Invention example |
| 11 | B: 0.0085 | 0.224 | 56 | Invention example |
| 12 | B: 0.0031 | 0.203 | 54 | Invention example |
| 13 | B: 0.0034 | 0.162 | 65 | Invention example |
| 14 | — | 0.166 | 35 | Invention example |
| 15 | — | 0.172 | 50 | Invention example |
| 16 | — | 0.174 | 45 | Comparative example |
| 17 | — | 0.138 | 44 | Comparative example |
| 18 | — | 0.109 | 48 | Comparative example |
| 19 | — | 0.272 | 60 | Comparative example |

TABLE 1-continued

| | | | | |
|---|---|---|---|---|
| 20 | — | 0.266 | 61 | Comparative example |
| 21 | — | 0.251 | 59 | Comparative example |
| 22 | — | 0.241 | 68 | Comparative example |
| 23 | — | 0.217 | 10 | Comparative example |
| 24 | — | 0.112 | 37 | Comparative example |
| 25 | — | 0.304 | 65 | Comparative example |
| 26 | — | 0.200 | 38 | Comparative example |
| 27 | — | 0.154 | 25 | Comparative example |
| 28 | — | 0.166 | 48 | Invention example |
| 29 | La: 0.0075 Ce: 0.018 Pr: 0.0006 Nd: 0.0031 | 0.170 | 45 | Invention example |
| 30 | Ca: 0.0022, Mg: 0.0023 | 0.156 | 45 | Invention example |
| 31 | B: 0.0032 | 0.152 | 48 | Invention example |
| 32 | — | 0.189 | 55 | Invention example |
| 33 | — | 0.177 | 58 | Invention example |
| 34 | — | 0.180 | 62 | Invention example |
| 35 | — | 0.160 | 38 | Invention example |

Underline indicates the value is out of range of present invention.
Balance, other than above components, is Fe and incidental impurities.

TABLE 2

| Steel No. | Strength 0.2% yield strength evaluation | Weldability Presence or absence of blowholes formed | Corrosion resistance Pitting potential evaluation | Notes |
|---|---|---|---|---|
| 1 | ○ | ○ | ⊙ | Invention example |
| 2 | ○ | ○ | ⊙ | Invention example |
| 3 | ○ | ○ | ⊙ | Invention example |
| 4 | ○ | ○ | ⊙ | Invention example |
| 5 | ○ | ○ | ⊙ | Invention example |
| 6 | ○ | ○ | ⊙ | Invention example |
| 7 | ○ | ○ | ⊙ | Invention example |
| 8 | ○ | ○ | ⊙ | Invention example |
| 9 | ○ | ○ | ○ | Invention example |
| 10 | ○ | ○ | ○ | Invention example |
| 11 | ○ | ○ | ⊙ | Invention example |
| 12 | ○ | ○ | ⊙ | Invention example |
| 13 | ○ | ○ | ○ | Invention example |
| 14 | ○ | ○ | ⊙ | Invention example |
| 15 | ○ | ○ | ⊙ | Invention example |
| 16 | X | ○ | ⊙ | Comparative example |
| 17 | X | ○ | ⊙ | Comparative example |
| 18 | X | ○ | ⊙ | Comparative example |
| 19 | ○ | X | ⊙ | Comparative example |
| 20 | ○ | X | ⊙ | Comparative example |
| 21 | ○ | X | ⊙ | Comparative example |
| 22 | ○ | X | ⊙ | Comparative example |
| 23 | X | X | ⊙ | Comparative example |
| 24 | X | ○ | ⊙ | Comparative example |
| 25 | ○ | X | ⊙ | Comparative example |
| 26 | Hot rolling cracking occurred. | | | Comparative example |
| 27 | X | X | ⊙ | Comparative example |
| 28 | ○ | ○ | ○ | Invention example |
| 29 | ○ | ○ | ○ | Invention example |
| 30 | ○ | ○ | ○ | Invention example |
| 31 | ○ | ○ | ○ | Invention example |
| 32 | ○ | ○ | ○ | Invention example |
| 33 | ○ | ○ | ○ | Invention example |
| 34 | ○ | ○ | ○ | Invention example |
| 35 | ○ | ○ | ○ | Invention example |

Steels within the ranges of the present invention (steels Nos. 1 to 15 and 28 to 35) were all given ratings of "pass", with no formation of blowholes during welding and with excellent strength. In addition, these steels were rated as "○" or "⊙" for corrosion resistance and therefore found to have excellent corrosion resistance, too. Of these, steels Nos. 1 to 8, 11, 12, 14, and 15 were rated as "⊙" for corrosion resistance and thus particularly had excellent corrosion resistance. Steel No. 9, which had a Ni content less than 0.50%, steel No. 10, which had a Ni content less than 0.50% and a Mn content greater than 5.00%, steel No. 13, which had a Cr content less than 19.0%, steels Nos. 28 to 34, each of which had a Mo content less than 0.1%, and steel No. 35, which had a Mn content greater than 5.00% were rated as "○" for corrosion resistance.

In contrast, steels outside the ranges of the present invention were rated as "fail" for at least one or more evaluations and therefore did not have the target properties. Specifically, first, steel No. 16 had a Zr content less than the lower limit of the range of the present invention and, as a result, did not have the desired strength. Steels Nos. 17 and 18 did not satisfy formula (1) and, as a result, did not have the desired strength.

Steels Nos. 19 and 21 had a Zr content less than the lower limit of the range of the present invention and did not satisfy formula (2). As a result, Steels Nos. 19 and 21 had blowholes formed during welding.

Steels Nos. 20 and 22 did not satisfy formula (2) and, as a result, had blowholes formed during welding.

Steel No. 23 had a Cr content greater than the upper limit of the range of the present invention and, as a result, did not have the desired strength because of a reduced γ-phase fraction. Further, Steel No. 23 had blowholes formed during welding.

Steel No. 24 had a N content less than the lower limit of the range of the present invention and did not satisfy formula (1). As a result, Steel No. 24 did not have the desired strength.

Steel No. 25 had a N content greater than the upper limit of the range of the present invention and did not satisfy formula (2). As a result, Steel No. 25 had blowholes formed during welding.

Steel No. 26 had a Mn content greater than the upper limit of the present invention and, as a result, exhibited hot rolling cracking. Thus, Steel No. 26 could not be evaluated.

Steel No. 27 had a Mn content less than the lower limit of the range of the present invention and therefore the amount of dissolved N in the α phase was reduced. As a result, Steel No. 27 had blowholes formed during welding. Furthermore, because of a reduced γ-phase fraction, the desired strength was not achieved.

Aspects of the present invention make it possible to obtain a ferritic-austenitic duplex stainless steel having excellent strength and weldability and is therefore very beneficial in the industry.

The invention claimed is:

1. A ferritic-austenitic duplex stainless steel sheet having a chemical composition comprising, in mass %, C: 0.10% or less,
Si: 1.0% or less,
Mn: 2.0to 7.0%,
P: 0.07% or less,
S: 0.030% or less,
Cr: 18.0 to 24.0%,
Ni: 0.1 to 3.0%,
Mo: 0.01 to 1.0%,
Cu: 0.1 to 3.0%,
Al: 0.003 to 0.10%,
Zr: 0.03 to 0.50%, and
N: 0.15 to 0.30%, with the balance being Fe and incidental impurities, the chemical composition satisfying formula (1) below and formula (2) below, $$N—Zr/6.5 \geq 0.15\% \quad (1)$$

$$N—Zr/6.5 \leq 0.23\% \quad (2)$$

where, in formula (1) and formula (2), N represents a content (mass %) of the corresponding chemical element N and Zr represents a content (mass %) of the corresponding chemical element Zr and, wherein when a machined edge face of each of two ferritic-austenitic duplex steel sheets, each having a thickness of 4.0 mm, are butt-welded together, along a groove, by TIG welding, and then entire cross sections of a weld metal zone and a weld heat affected zone (HAZ) are examined, no blowholes 3 μm or greater in diameter are present, where the groove is an I-type groove and, where the welding conditions are as follows: current, 220 A; voltage, 15 V; welding speed, 200 mm/min; welding wire, none; shielding gas, Ar; gas flow rate, 15 1/min for both front and back sides.

2. A ferritic-austenitic duplex stainless steel sheet having a chemical composition comprising, in mass %, C: 0.10% or less,
Si: 1.0% or less,
Mn: 2.0 to 7.0%,
P: 0.07% or less,
S: 0.030% or less,
Cr: 18.0 to 24.0%,
Ni: 0.1 to 3.0%,
Mo: 0.1 to 1.0%,
Cu: 0.1 to 3.0%,
Al: 0.003 to 0.10%,
Zr: 0.03 to 0.50%, and
N: 0.15 to 0.30%, with the balance being Fe and incidental impurities, the chemical composition satisfying formula (1) below and formula (2) below, $$N—Zr/6.5 \geq 0.15\% \quad (1)$$

$$N—Zr/6.5 \leq 0.23\% \quad (2)$$

where, in formula (1) and formula (2), N represents a content (mass %) of the corresponding chemical element N and Zr represents a content (mass %) of the corresponding chemical element Zr and, wherein when a machined edge face of each of two ferritic-austenitic duplex steel sheets, each having a thickness of 4.0 mm, are butt-welded together, along a groove, by TIG welding, and then entire cross sections of thea weld metal zone and thea weld heat affected zone (HAZ) are examined, no blowholes 3 μm or greater in diameter are present, where the groove is an I-type groove and, where the welding conditions are as follows: current, 220 A; voltage, 15 V; welding speed, 200 mm/min; welding wire, none; shielding gas, Ar; gas flow rate, 15 1/min for both front and back sides.

3. The ferritic-austenitic duplex stainless steel sheet according to claim 1, wherein the chemical composition further comprises, in mass %, one or more of B: 0.01% or less,
Ca: 0.01% or less,
Mg: 0.01% or less, and
one or more REMs (rare earth metals): 0.1% or less.

4. The ferritic-austenitic duplex stainless steel sheet according to claim 2, wherein the chemical composition further comprises, in mass %, one or more of B: 0.01% or less,
Ca: 0.01% or less,
Mg: 0.01% or less, and
one or more REMs (rare earth metals): 0.1% or less.

5. The ferritic-austenitic duplex stainless steel sheet according to claim 1, wherein in mass %, the amount of Mn is 2.0 to 4.00%.

6. The ferritic-austenitic duplex stainless steel sheet according to claim 2, wherein in mass %, the amount of Mn is 2.0 to 4.00%.

7. The ferritic-austenitic duplex stainless steel sheet according to claim 3, wherein in mass %, the amount of Mn is 2.0 to 4.00%.

8. The ferritic-austenitic duplex stainless steel sheet according to claim 4, wherein in mass %, the amount of Mn is 2.0 to 4.00%.

9. The ferritic-austenitic duplex stainless steel sheet according to claim 1, wherein in mass %, the amount of Cu is 0.30 to 3.0%.

10. The ferritic-austenitic duplex stainless steel sheet according to claim 2, wherein in mass %, the amount of Cu is 0.30 to 3.0%.

11. The ferritic-austenitic duplex stainless steel sheet according to claim 3, wherein in mass %, the amount of Cu is 0.30 to 3.0%.

12. The ferritic-austenitic duplex stainless steel sheet according to claim 4, wherein in mass %, the amount of Cu is 0.30 to 3.0%.

13. The ferritic-austenitic duplex stainless steel sheet according to claim 5, wherein in mass %, the amount of Cu is 0.30 to 3.0%.

14. The ferritic-austenitic duplex stainless steel sheet according to claim 6, wherein in mass %, the amount of Cu is 0.30 to 3.0%.

15. The ferritic-austenitic duplex stainless steel sheet according to claim 7, wherein in mass %, the amount of Cu is 0.30 to 3.0%.

16. The ferritic-austenitic duplex stainless steel sheet according to claim 8, wherein in mass %, the amount of Cu is 0.30 to 3.0%.

* * * * *